US007992304B2

(12) United States Patent
Nakasuka

(10) Patent No.: US 7,992,304 B2
(45) Date of Patent: Aug. 9, 2011

(54) RAZOR

(75) Inventor: Hiroyuki Nakasuka, Seki (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 407 days.

(21) Appl. No.: 12/223,873

(22) PCT Filed: Feb. 14, 2007

(86) PCT No.: PCT/JP2007/052560

§ 371 (c)(1),
(2), (4) Date: Aug. 12, 2008

(87) PCT Pub. No.: WO2007/094337

PCT Pub. Date: Aug. 23, 2007

(65) Prior Publication Data

US 2010/0154222 A1 Jun. 24, 2010

(30) Foreign Application Priority Data

Feb. 14, 2006 (JP) ..... 2006-036665

(51) Int. Cl.
*B26B 21/00* (2006.01)

(52) U.S. Cl. ..... 30/50

(58) Field of Classification Search ..... 30/47, 50–64, 30/75, 84

See application file for complete search history.

(56) References Cited

U.S. PATENT DOCUMENTS 3,940,853 A 3/1976 Francis
4,200,976 A 5/1980 Gooding
4,324,041 A * 4/1982 Trotta ..... 30/47
4,337,575 A * 7/1982 Trotta ..... 30/47
4,403,412 A * 9/1983 Trotta ..... 30/47
4,403,413 A * 9/1983 Trotta ..... 30/47
4,516,321 A 5/1985 Francis
4,709,477 A * 12/1987 Ferraro ..... 30/50
4,774,765 A * 10/1988 Ferraro ..... 30/50

(Continued)

FOREIGN PATENT DOCUMENTS

EP 0858869 8/1998

(Continued)

OTHER PUBLICATIONS

European Search Report issued by the European Patent Office on Feb. 25, 2010 in connection with corresponding European patent application No. 07708364.0-2313 (and English translation).

(Continued)

*Primary Examiner* — Jason Daniel Prone
(74) *Attorney, Agent, or Firm* — Posz Law Group, PLC

(57) ABSTRACT

A razor having a simplified structure is provided. This oscillating razor is provided with a razor head. The razor head is provided with a blade member composed of a base having a blade-body supporting portion and a plurality of blade bodies, a blade base member located on the back side of the razor head, and a top member located on the front side of the razor head. The blade member is fitted between the blade base member and the top member. The base is supported on the blade base member and the cutting edge of the blade body is exposed outward at the top member. Each of the blade bodies is placed on the blade-body supporting portion, and welded portions fixed to each other by welding from the side corresponding to the blade-body supporting portion are formed on the blade body and the blade-body supporting portion.

16 Claims, 7 Drawing Sheets

U.S. PATENT DOCUMENTS

| | | | | | |
|---|---|---|---|---|---|
| 5,070,612 | A | * | 12/1991 | Abatemarco | 30/50 |
| 5,074,042 | A | | 12/1991 | Althaus et al. | |
| 5,222,300 | A | | 6/1993 | Althaus et al. | |
| 5,251,376 | A | * | 10/1993 | Althaus et al. | 30/50 |
| 5,253,420 | A | | 10/1993 | Althaus et al. | |
| 5,365,665 | A | | 11/1994 | Coffin | |
| 5,377,409 | A | * | 1/1995 | Chen | 30/50 |
| 5,416,974 | A | | 5/1995 | Wain | |
| 5,546,660 | A | | 8/1996 | Burout et al. | |
| 6,295,734 | B1 | * | 10/2001 | Gilder et al. | 30/50 |
| 6,397,473 | B1 | * | 6/2002 | Clark | 30/50 |
| 6,671,961 | B1 | * | 1/2004 | Santhagens Van Eibergen et al. | 30/50 |
| 6,877,227 | B2 | * | 4/2005 | Santhagens Van Eibergen et al. | 30/50 |
| 7,191,523 | B2 | * | 3/2007 | Miyazaki et al. | 30/50 |
| 7,621,203 | B2 | * | 11/2009 | Aviza | 30/51 |
| 7,676,929 | B2 | * | 3/2010 | Lembke et al. | 30/50 |
| 7,877,879 | B2 | * | 2/2011 | Nakasuka | 30/50 |
| 2003/0046819 | A1 | | 3/2003 | Ferraro et al. | |
| 2003/0159291 | A1 | * | 8/2003 | Clark | 30/50 |
| 2003/0217472 | A1 | * | 11/2003 | Follo | 30/50 |
| 2004/0020053 | A1 | * | 2/2004 | Wain | 30/50 |
| 2004/0118250 | A1 | * | 6/2004 | White et al. | 30/50 |
| 2004/0168322 | A1 | * | 9/2004 | Richard | 30/50 |
| 2004/0216310 | A1 | | 11/2004 | Santhagens Van Eibergen | |
| 2004/0255467 | A1 | * | 12/2004 | Lembke et al. | 30/50 |
| 2005/0172495 | A1 | * | 8/2005 | Pennella | 30/50 |
| 2006/0032056 | A1 | * | 2/2006 | Coffin et al. | 30/50 |
| 2007/0151106 | A1 | * | 7/2007 | Steunenberg et al. | 30/50 |
| 2007/0256303 | A1 | * | 11/2007 | Lembke et al. | 30/50 |
| 2008/0066315 | A1 | * | 3/2008 | Xu | 30/50 |
| 2008/0250646 | A1 | * | 10/2008 | Nakasuka | 30/34.05 |
| 2008/0256800 | A1 | * | 10/2008 | Nicoll | 30/50 |
| 2009/0113716 | A1 | * | 5/2009 | Wain et al. | 30/50 |
| 2009/0260238 | A1 | * | 10/2009 | Nakasuka | 30/527 |
| 2009/0307908 | A1 | * | 12/2009 | Nakasuka | 30/41 |
| 2010/0077617 | A1 | * | 4/2010 | Peterson et al. | 30/50 |
| 2010/0154220 | A1 | * | 6/2010 | Nakasuka | 30/41.6 |
| 2010/0154222 | A1 | * | 6/2010 | Nakasuka | 30/50 |
| 2010/0229397 | A1 | * | 9/2010 | Nakasuka | 30/50 |

FOREIGN PATENT DOCUMENTS

| | | | | |
|---|---|---|---|---|
| EP | 1985418 | A1 | * | 10/2008 |
| EP | 1990142 | A1 | * | 11/2008 |
| EP | 1990143 | A1 | * | 11/2008 |
| EP | 2078593 | A1 | * | 7/2009 |
| EP | 1718438 | | | 9/2009 |
| JP | U-60-47469 | | | 4/1985 |
| JP | 04361782 | A | * | 12/1992 |
| JP | 04361783 | A | * | 12/1992 |
| JP | A-05-000191 | | | 1/1993 |
| JP | A-05-000192 | | | 1/1993 |
| JP | A-05-184739 | | | 7/1993 |
| JP | A-05-184740 | | | 7/1993 |
| JP | A-05-184741 | | | 7/1993 |
| JP | A-06-047174 | | | 2/1994 |
| JP | A-06-126046 | | | 5/1994 |
| JP | A-10-258190 | | | 9/1998 |
| JP | A-10-263220 | | | 10/1998 |
| JP | A-2000-262777 | | | 9/2000 |
| JP | A-2001-079281 | | | 3/2001 |
| JP | A-P2001-334079 | | | 12/2001 |
| JP | A-2003-220285 | | | 8/2003 |
| JP | A-2005-161066 | | | 6/2005 |
| WO | WO 84/02303 | | | 6/1984 |
| WO | WO 88/09710 | | | 12/1988 |
| WO | WO 91/14546 | | | 10/1991 |
| WO | WO 9114546 | A1 | * | 10/1991 |
| WO | WO 91/19597 | | | 12/1991 |
| WO | WO 93/01917 | | | 2/1993 |
| WO | WO 9301917 | A1 | * | 2/1993 |
| WO | WO 94/11163 | | | 5/1994 |
| WO | WO 9411163 | A1 | * | 5/1994 |
| WO | WO 96/10472 | | | 4/1996 |
| WO | WO 96/29183 | | | 9/1996 |
| WO | WO 96/32233 | | | 10/1996 |
| WO | WO 98/05478 | | | 2/1998 |
| WO | WO 98/35795 | | | 8/1998 |
| WO | WO 01/39937 | | | 6/2001 |
| WO | WO 03/064119 | | | 8/2003 |
| WO | WO 2004/073939 | | | 9/2004 |
| WO | WO 2007029552 | A1 | * | 3/2007 |
| WO | WO 2007029553 | A1 | * | 3/2007 |
| WO | WO 2007/094335 | | | 8/2007 |
| WO | WO 2007/094336 | | | 8/2007 |
| WO | WO 2007094335 | A1 | * | 8/2007 |
| WO | WO 2007094336 | A1 | * | 8/2007 |
| WO | WO 2007094337 | A1 | * | 8/2007 |

OTHER PUBLICATIONS

European Search Report issued by the European Patent Office on Feb. 24, 2010 in connection with corresponding European patent application No. 07714137.2-2313 (and English translation), which corresponds to related U.S. Appl. No. 12/223,870.

European Search Report issued by the European Patent Office on Feb. 24, 2010 in connection with corresponding European patent application No. 07714136.4-2313 (and English translation), which corresponds to related U.S. Appl. No. 12/223,872.

"Laser Welding", http://www.sanpo-pub.co.jp/omoshiro/freshman/post_388.html, printed on Jan. 6, 2006 (4 pages total including an English translation of webpage excerpt).

"Ionization Tendency," http://www.max.hi-ho.ne.jp/lylle/denchi2.html printed on Jan. 5, 2006 (3 pages total including an English translation of webpage excerpt).

PCT International Search Report mailed on May 15, 2007 for the corresponding International patent application No. PCT/JP2007/052560.

Notification of Transmittal of Translation of the International Search Report on Patentability dated Aug. 28, 2008 in corresponding PCT application No. PCT/JP2007/052560.

Notification of Transmittal of Translation of the International Search Report on Patentability dated Aug. 28, 2008 in corresponding PCT application No. PCT/JP2007/052558.

Notification of Transmittal of Translation of the International Search Report on Patentability dated Aug. 28, 2008 in corresponding PCT application No. PCT/JP2007/052559.

First Office Action issued from the U.S. Patent and Trademark Office on Nov. 17, 2010 for the related U.S. Appl. No. 12/223,870.

Office Action issued from the U.S. Patent and Trademark Office on Jan. 12, 2011 for related U.S. Appl. No. 12/223,872.

* cited by examiner 28c
28a
28
28b
3
6
28d 26c
26a
26
26b
23
6
26d 2
3
5
6
24c
28c
28a
24a
44
24
24b
44
24d B
A
28b
28c
28
28a
A
B
3
6
5
2
24d
28d

RAZOR

CROSS REFERENCE TO RELATED APPLICATIONS

This application is a U.S. national stage application of PCT/JP2007/052560 filed on Feb. 14, 2007, and claims priority to, and incorporates by reference, Japanese Patent Application No. 2006-036665 filed on Feb. 14, 2006. This application is related to concurrently filed U.S. application Ser. No. 12/223,872, entitled "RAZOR", which is a U.S. national stage application of PCT Application No. PCT/JP2007/052558 filed on Feb. 14, 2007, and concurrently filed U.S. application Ser. No. 12/223,870, entitled "RAZOR", which is a U.S. national stage application of PCT Application No. PCT/JP2007/052559 filed on Feb. 14, 2007.

FIELD OF THE INVENTION

The present invention relates to a structure for supporting a blade body in a razor head in a razor provided with the razor head having the blade body.

BACKGROUND OF THE INVENTION

Japanese Patent No. 2963824 discloses a movable blade-body type safety razor having the following configuration. Specifically, the safety razor is provided with a blade base having a frame body and a top plate placed on the blade base. The frame body is provided with a guard, a back frame portion located at the back of the guard, and side frame portions located on both right and left sides of the guard. A plurality of elastic arms and a plurality of blade body placing portions are disposed inside the frame body, and the elastic arms and the blade body placing portions are coupled to each other. On the blade body placing portions at the front and on the blade body placing portions at the back, blade bodies are placed individually. The top plate is provided with holding portions at positions corresponding to each blade body. Each blade body is held between the corresponding blade body placing portions and the corresponding holding portion, and movable together with each blade body placing portion and the top plate against the elasticity of each of the elastic arms.

However, the structure for supporting the blade body described in Japanese Patent No. 2963824 has the following problem. That is, since each blade body is held between a blade body placing portion coupled to an elastic arm and a holding portion of the top plate, it is troublesome to form the blade base having the elastic arms and the blade body placing portions. Also, since the top plate moves together with the blade bodies, the structure of a razor is complicated.

SUMMARY OF THE INVENTION

An objective of the present invention is to provide a razor having a simple configuration.

According to one aspect of the present invention, there is provided a razor having a razor head. The razor head is provided with a blade member composed of a base having a blade-body supporting portion, a blade base member located on the bottom side of the razor head, and a top member located on the top side of the razor head. The blade member is fitted between the blade base member and the top member, the base of the blade member is supported on the blade base member, and a cutting edge of the blade body is exposed outward at the top member. The blade body is placed on the blade-body supporting portion of the base and also attached to the blade-body supporting portion by welding.

According to the above configuration, a single-component blade member in which the blade body is welded to the blade-body supporting portion of the base is fitted between the blade base member and the top member, by which a structure for supporting the blade body is simplified and also the blade body is easily attached to the blade-body supporting portion of the base. The single-component blade member means that the blade member is separated from the blade base member and the top member. If the single-component blade member is provided with a plurality of blade bodies, it is acceptable that at least some of the blade bodies are attached to the blade-body supporting portions of the base by welding. Alternatively, all the blade bodies may be attached to the blade-body supporting portions by welding. Further, some of the blade bodies may be attached to the blade-body supporting portions by welding while the remaining blade bodies are formed integrally with the blade-body supporting portions.

According to another aspect of the present invention, there is provided a razor having a razor head. The razor head is provided with a blade base member, a blade member, and a skin surface contact portion. The blade base member is located on the bottom side of the razor head. The blade member is supported on the blade base member. The blade member includes a base having a blade-body supporting portion and a blade body exposed outward on the front side of the razor head. The skin surface contact portion contacts a skin surface together with a cutting edge of the blade body. The blade body is placed on the blade-body supporting portion of the base, and welded portions fixed to each other by welding from a side corresponding to the blade-body supporting portion are disposed in the blade body and the blade-body supporting portion.

According to the above configuration, since the blade body is welded to the blade-body supporting portion from the side corresponding to the blade-body supporting portion, the blade body is easily attached to the blade-body supporting portion of the base, thus simplifying the structure for supporting the blade body. Further, since the blade body is not directly welded to the front side, no welded spots are visible on the front side of the blade body.

It is preferable that, at the welded portions, the thickness of the blade-body supporting portion is set to be greater than the thickness of the blade body. This configuration increases the rigidity of the blade-body supporting portion.

It is preferable that the welding is laser welding. According to this configuration, the blade body can be easily attached to the blade-body supporting portion of the base.

It is preferable that the base of the blade member is provided with a pair of mutually facing placing bodies and also a placing base supported on the blade base member. In this instance, the blade-body supporting portion is constructed between a pair of placing bodies. This configuration simplifies the structure of the blade member.

The blade member is preferably provided with a plurality of blade bodies. In this instance, the blade-body supporting portion of the base is provided with a plurality of blade body attaching portions arranged parallel in a staircase pattern along a direction orthogonal to a direction in which the cutting edge of the blade body extends. Further, a plurality of the blade bodies are placed on each of the blade body attaching portions and attached to each of the blade body attaching portions by welding. According to this configuration, each blade body can be easily attached to the blade-body supporting portion of the base.

According to still another aspect of the present invention, there is provided a razor having a razor head. The razor head includes a blade base member, a blade member, and a skin surface contact portion. The blade base member is located on the bottom side of the razor head. The blade member is supported on the blade base member. The blade member includes a base having a blade-body supporting portion and a placing base, and a plurality of blade bodies exposed outward on the front side of the razor head. The skin surface contact portion contacts a skin surface together with the cutting edges of the blade bodies. The blade-body supporting portion and the placing base are formed integrally. The blade bodies are placed on the blade-body supporting portions of the base, and also attached to the blade-body supporting portions by welding.

According to the above configuration, each blade body is welded to the blade-body supporting portion of the base at which the blade-body supporting portion and the placing base are formed integrally. This simplifies the structure for supporting the blade bodies and allows the blade body to be easily attached to the blade-body supporting portion of the base.

It is preferable that the welding is laser welding. According to this configuration, the blade body can be easily attached to the blade-body supporting portion of the base.

It is preferable that the placing base of the base is provided with a pair of mutually facing placing bodies and also supported on the blade base member. In this instance, the blade-body supporting portion is constructed between the placing bodies. According this configuration simplifies the structure of the blade member.

It is preferable that the blade-body supporting portion of the base is provided with a plurality of blade body attaching portions arranged parallel in a staircase pattern along a direction orthogonal to a direction in which the cutting edge of the blade body extends. In this instance, the blade bodies are placed individually on the blade body attaching portions and also attached individually to the blade body attaching portions by welding. According to this configuration, each blade body can be easily attached to the blade-body supporting portion of the base.

It is preferable that the blade base member is also provided with a base plate. In this instance, the base of the blade member is supported on the base plate. Further, the base, the blade body and the base plate are made of metal materials. The base plate is made of a metal material having an ionization tendency higher than those of the metal materials of the base and the blade body. According to this configuration, the base plate is oxidized earlier than the blade body, thereby preventing the blade body from being rusted.

BRIEF DESCRIPTION OF THE DRAWINGS

FIG. 1(*b*) is a perspective view of the oscillating razor, as viewed from the front side;

FIG. 3(*b*) is a perspective view of a blade base member in which a base plate is placed on a bottom base;

FIG. 3(*c*) is a perspective view showing a state in which the base of the blade member is placed on the base plate of the blade base member;

FIG. 4(*b*) is a perspective view showing a state in which the blade member and the base plate are fitted into the top member;

FIGS. 4(*c*) and 4(*d*) are perspective views showing the razor head in its entirety;

FIG. 5(*b*) is an enlarged cross-sectional view taken along line 5*b*-5*b* in FIG. 4(*d*);

FIG. 5(*c*) is a partially enlarged view of FIG. 5(*a*);

FIG. 6(*b*) is a bottom view of the razor head;

FIG. 7(*b*) is a side elevational view showing the head of the holder;

FIG. 8(*b*) is a partial cross-sectional view showing a structure for supporting the razor head relative to each supporting arm of the holder and a pressure-contact structure of the pusher of the holder relative to the razor head.

DETAILED DESCRIPTION OF THE PREFERRED EMBODIMENTS

Figure 1:
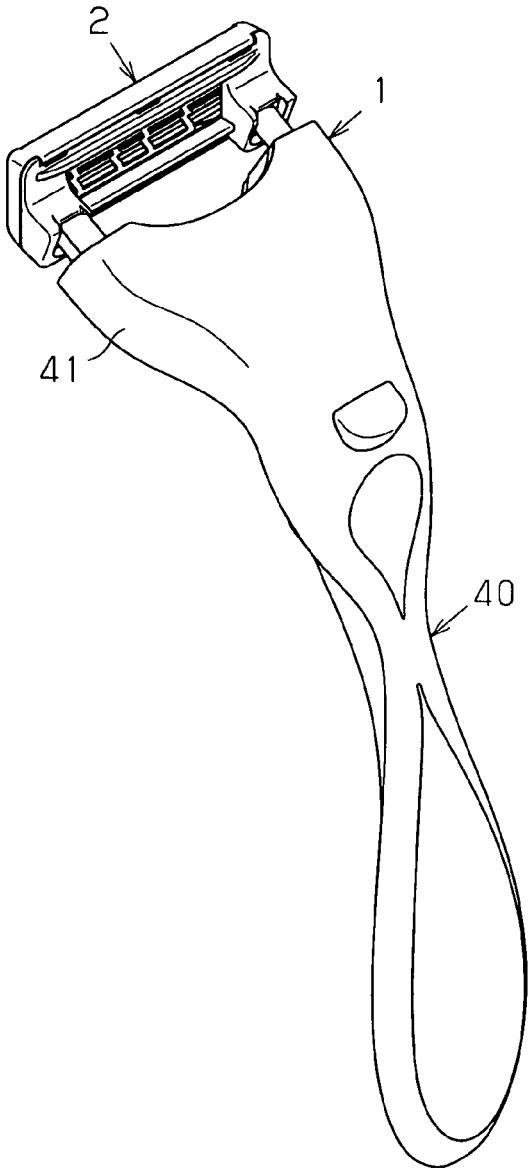
FIG. 1(*a*) is a perspective view of an oscillating razor of the present embodiment, as viewed from the bottom side.
Figure 1:
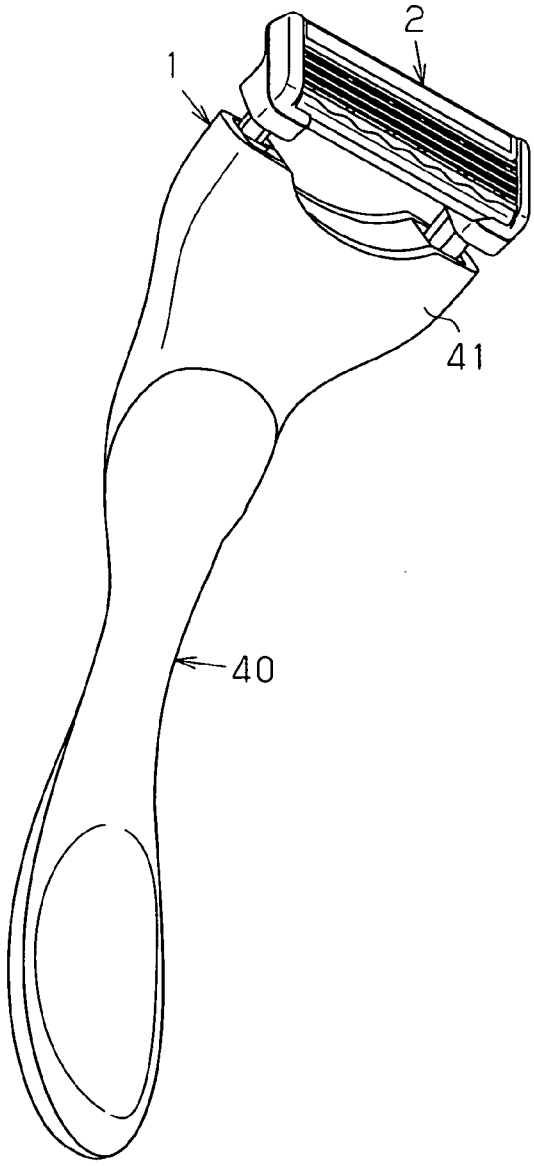

Hereinafter, a description will be given of an oscillating razor according to one embodiment of the present invention by referring to drawings. As shown in FIGS. 1(*a*) and 1(*b*), an oscillating razor 1 is provided with a razor head 2 and a holder 40. As shown in FIGS. 1(*a*) to 6(*b*), the razor head 2 is provided with a blade member 3 having a plurality of metal-made blade bodies 4, a blade base member 5 located on the bottom side of the razor head 2, and a top member 6 located on the top side of the razor head 2. The blade member 3 is fitted between the blade base member 5 and the top member 6. A metal which forms the blade bodies 4 includes, for example, martensite stainless steel. The number of blade bodies 4 is, for example, four.

Figure 2:
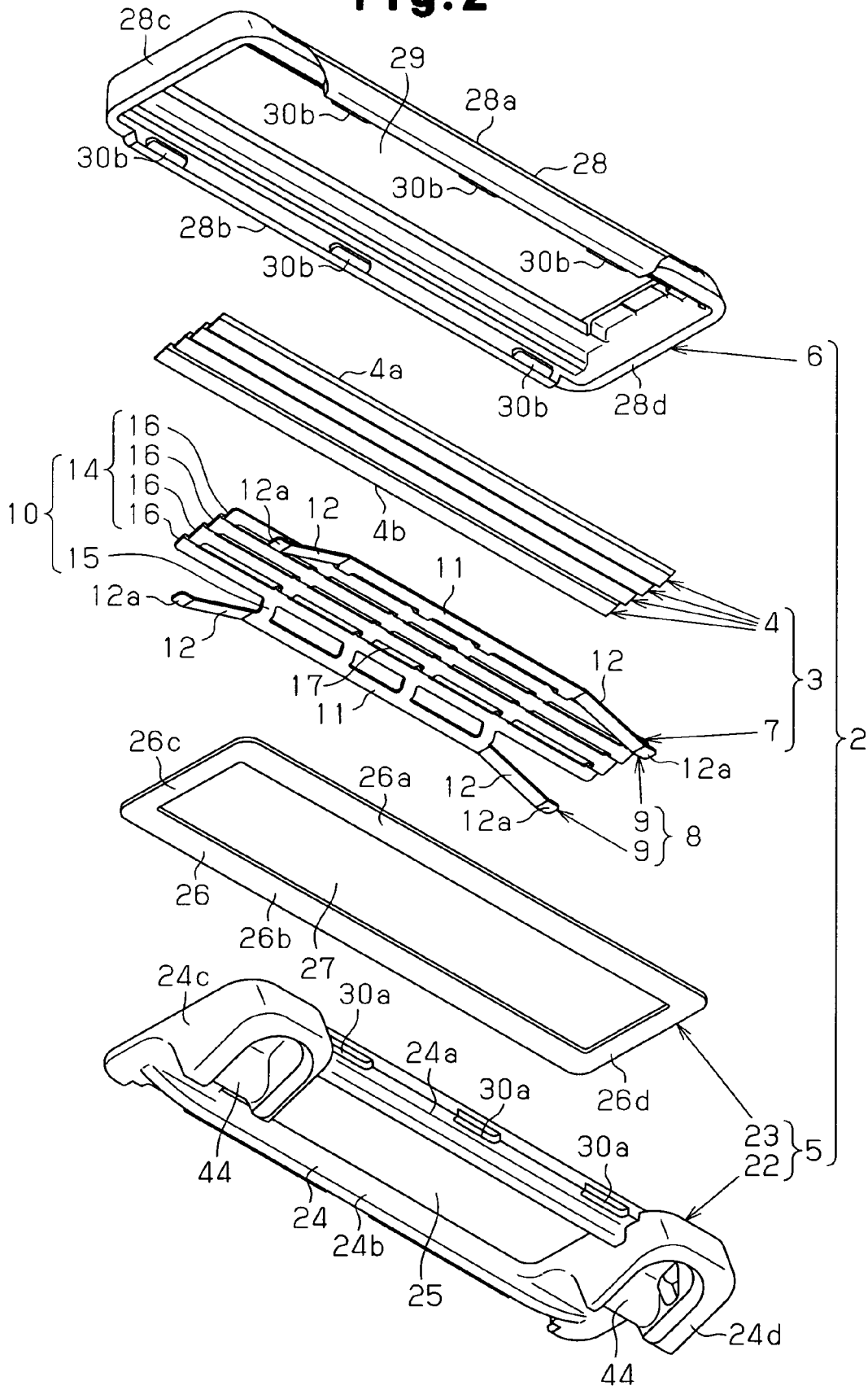
FIG. 2 is an exploded perspective view of a razor head of the oscillating razor.

As shown in FIG. 2, the blade member 3 is provided with a base 7 located on the bottom side of the blade bodies 4. The base 7 is formed by a placing base 8 composed of leaf springs 9 as placing bodies, or supporting edge portions. The placing base 8 is disposed at both end portions in a direction orthogonal to a direction in which the cutting edge 4*a* of each blade body 4 extends, that is, the X axis direction given in FIG. 6(*a*), and a blade-body supporting portion 10 is constructed between the leaf springs 9. Each of the leaf springs 9 is provided with a supporting plate 11 extending in a direction in which the cutting edge 4*a* of the blade body 4 extends, that is, the Y axis direction given in FIG. 6(*a*).

Figures 3A, 3B, 3C:
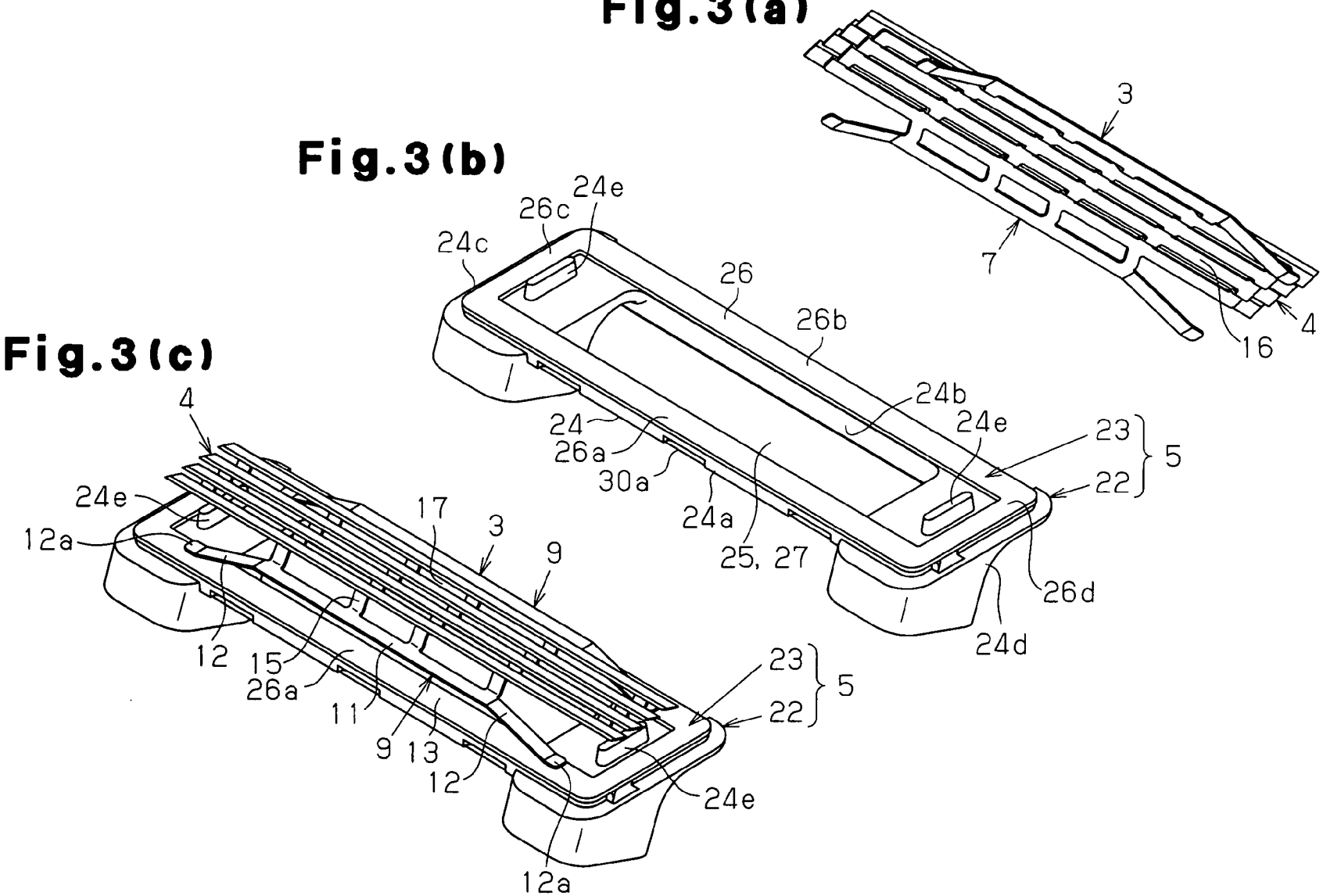
FIG. 3(*a*) is a perspective view of a blade member in which each blade body is attached to a base.

Both end portions of each supporting plate 11 in the Y axis direction, that is, both right and left end portions of each supporting plate 11, are bent toward the blade base member 5 to form leg plates 12 as leg portions. As shown in FIG. 3(*c*), a deflection allowance space 13 is defined between each supporting plate 11 and each leg plate 12. The placing base 8 and the blade-body supporting portion 10 which form the base 7 are formed integrally with each other by subjecting a plate material made of a metal, for example, austenite stainless steel, to press working. The length of the base 7 of the present embodiment in the X axis direction is about 9 mm, and the length of the base 7 in the Y axis direction is about 34 mm.

As shown in FIG. 2, the blade-body supporting portion 10 is formed by a blade body attaching plate 14 composed of step plates 16 as a plurality of blade body attaching portions arranged parallel along the X axis direction and a plurality of parallel cross-link arm portions 15 arranged along the Y axis direction from both edge portions of the blade body attaching plate 14 in the X axis direction. In the present embodiment, four parallel step plates 16 and four parallel cross-link arm portions 15 are also arranged as shown in FIG. 2.

Figure 5A:
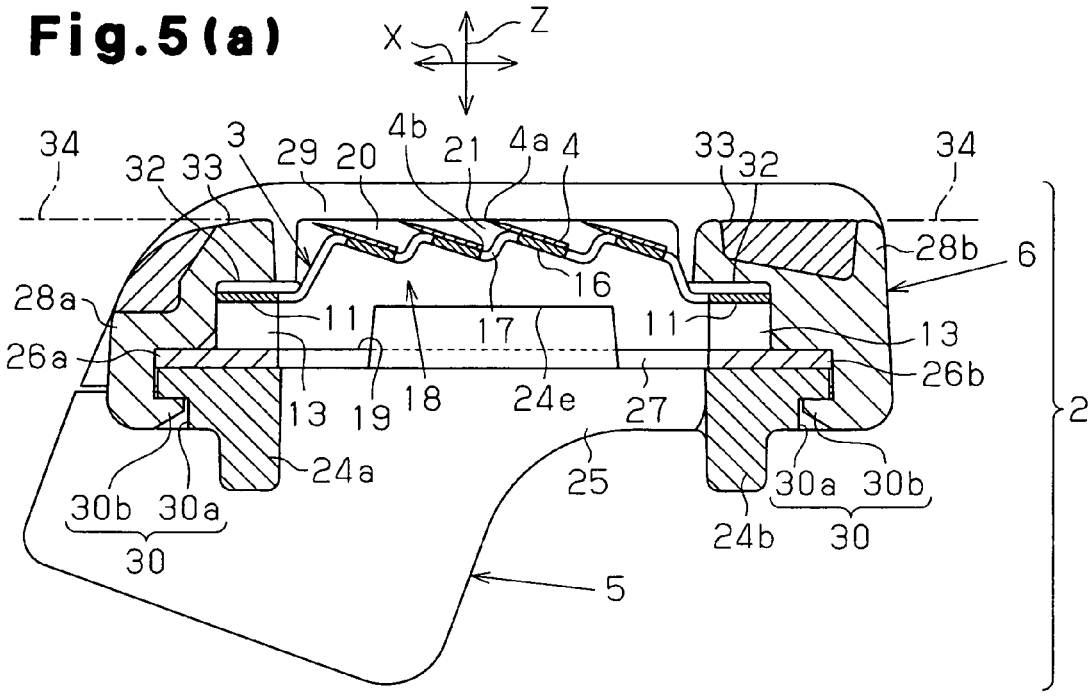
FIG. 5(*a*) is an enlarged cross-sectional view taken along line 5*a*-5*a* in FIG. 4(*d*)
Figure 5B:
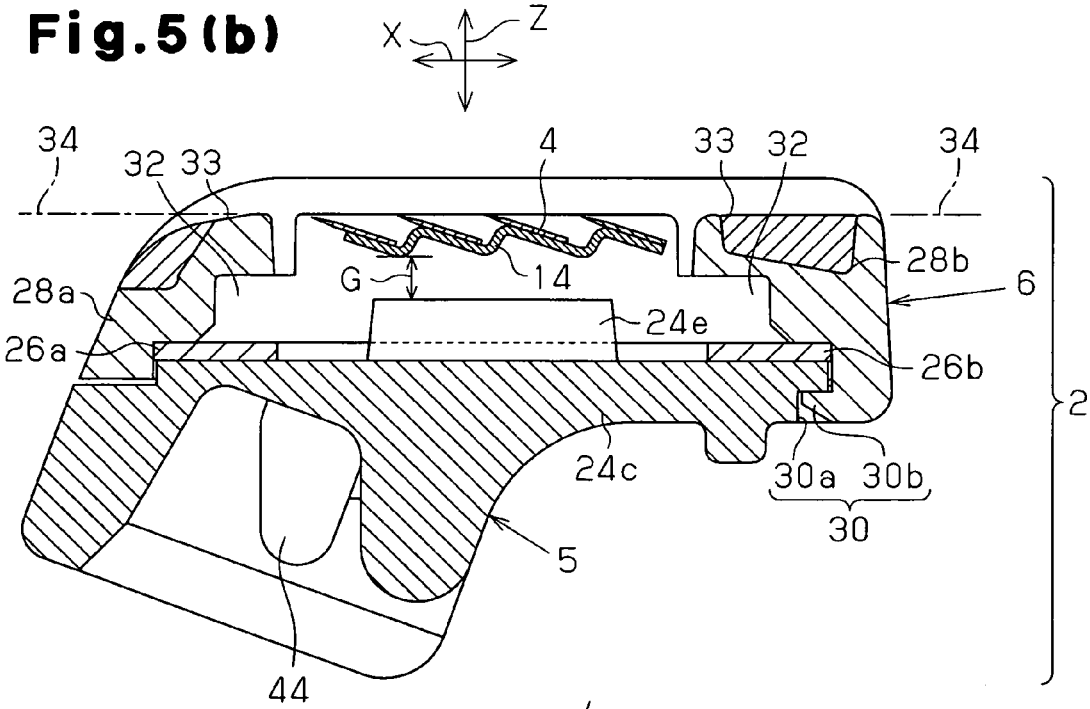
Figure 5C:
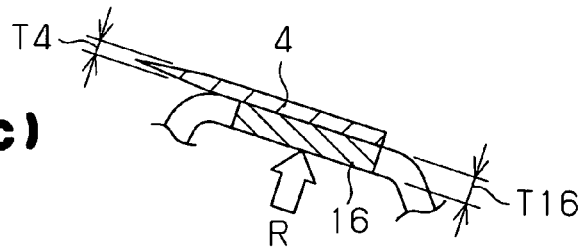

As shown in FIGS. 2 and 5(*a*), the step plates 16 are parallel to form a staircase pattern, and a plurality of parallel through holes 17 are arranged along the Y axis direction between mutually adjacent step plates 16. With the strength of the blade body attaching plate 14 taken into account, the length of the through holes 17 the Y axis direction is reduced toward both end portions in the Y axis direction. Each of the cross-link arm portions 15 is bent toward each of the leaf springs 9, and a space is defined internally at the blade body attaching plate 14. Each cross-link arm portion 15 is coupled to the supporting plate 11 of each leaf spring 9 and formed integrally with the supporting plate 11.

As shown in FIG. 5(*a*), a space defined inside the placing base 8 of the base 7 is opened outward to the placing base 8 through an opening 19 located on the bottom side of the placing base 8 and an opening 20 located on the top side of the placing base 8, thereby forming a debris discharge hole 18. The opening 19 is formed by a space defined by each of end portions 12*a* on a plane connecting the end portions 12*a* of each leg plate 12 on each leaf spring 9. The opening 20 is formed by the through holes 17 of the blade body attaching plate 14 and spaces defined in front of, behind, and to the right and left of the blade body attaching plate 14. The debris discharge hole 18 is opened outward to the placing base 8 in front of, behind, and to the left of the placing base 8.

As shown in FIGS. 5(*a*) to 5(*c*), the blade body 4 is placed on each step plate 16 of the blade body attaching plate 14 so as to extend along the Y axis direction. For example, laser welding by YAG laser or carbon dioxide gas laser is given from the step plate 16 to the blade body 4 at a plurality of spots, thereby forming on the blade body 4 and the step plate 16 welded portions R at which the blade body 4 and the step plate 16 are fixed to each other. Rust preventive oil is applied to the surface of the blade body 4. The surface is not directly welded on the step plate 16, thus making it possible to prevent the surface of the blade body 4 from being contaminated by welding at the welded portions R. Laser welding is given in a state where each step plate 16 is placed on a blade body 4 set on a jig.

At the welded portion R, the thickness of the step plate 16, or T16, is set to be greater than the thickness of the blade body 4, or T4. T16, or the thickness of the step plate 16, is in a range between 0.1 mm and 0.5 mm, inclusive, for example, and preferably in a range between 0.12 mm and 0.20 mm, inclusive. T4, or the thickness of the blade body 4, is in a range between 0.05 mm and 0.3 mm, inclusive, for example, and preferably in a range between 0.07 mm and 0.15 mm, inclusive. When a great quantity of heat resulting from welding is applied to the step plate 16, thermal strain will easily develop on the step plate 16.

Figure 6A:
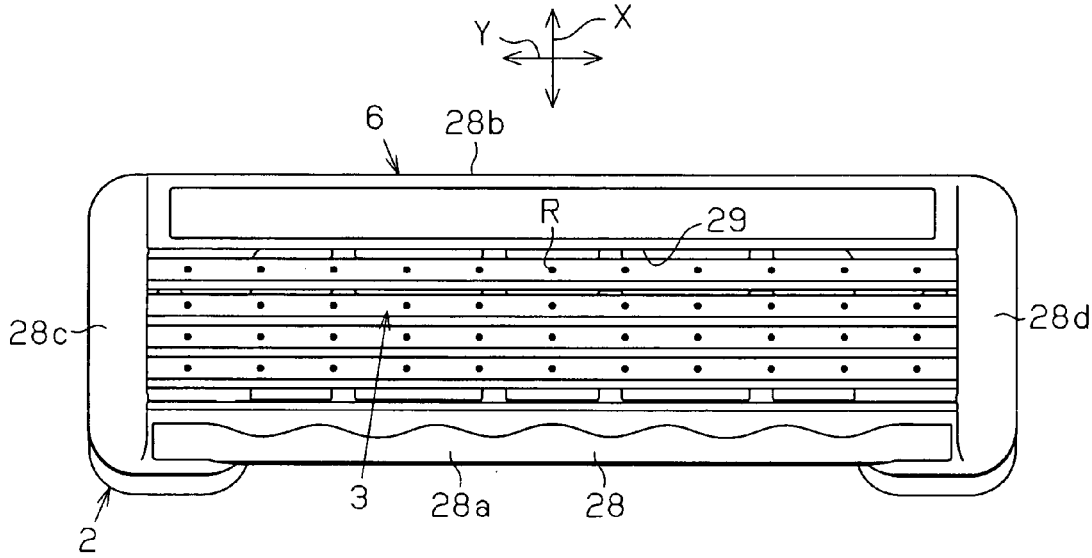
FIG. 6(*a*) is a front elevational view of the razor head.
Figure 6B:
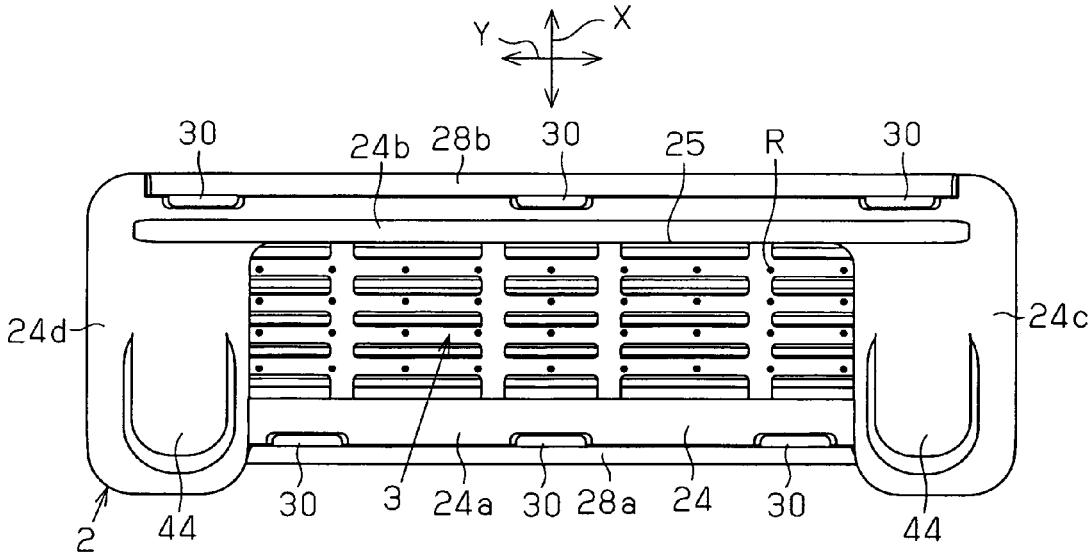

In order to impart an appropriate rigidity and suppress the thermal strain, T16, or the thickness of the step plate 16, is experimentally determined to be 0.15 mm as a design value in a range between 0.12 mm and 0.20 mm, inclusive. This thickness of T16 is determined with possible hardening of a material in association with press working of the base 7 taken into account. The pitch between the welded portions R in the Y axis direction is about 3 mm. As shown in FIGS. 6(*a*) and 6(*b*), in the present embodiment, each of the welded portions R is formed at the same site on each of mutually adjacent blade bodies 4. However, for each adjacent pair of the blade bodies 4, welded portions R of one of the pair may be formed between individual welded portions R of the other of the pair.

Figures 4A, 4B, 4C, 4D:
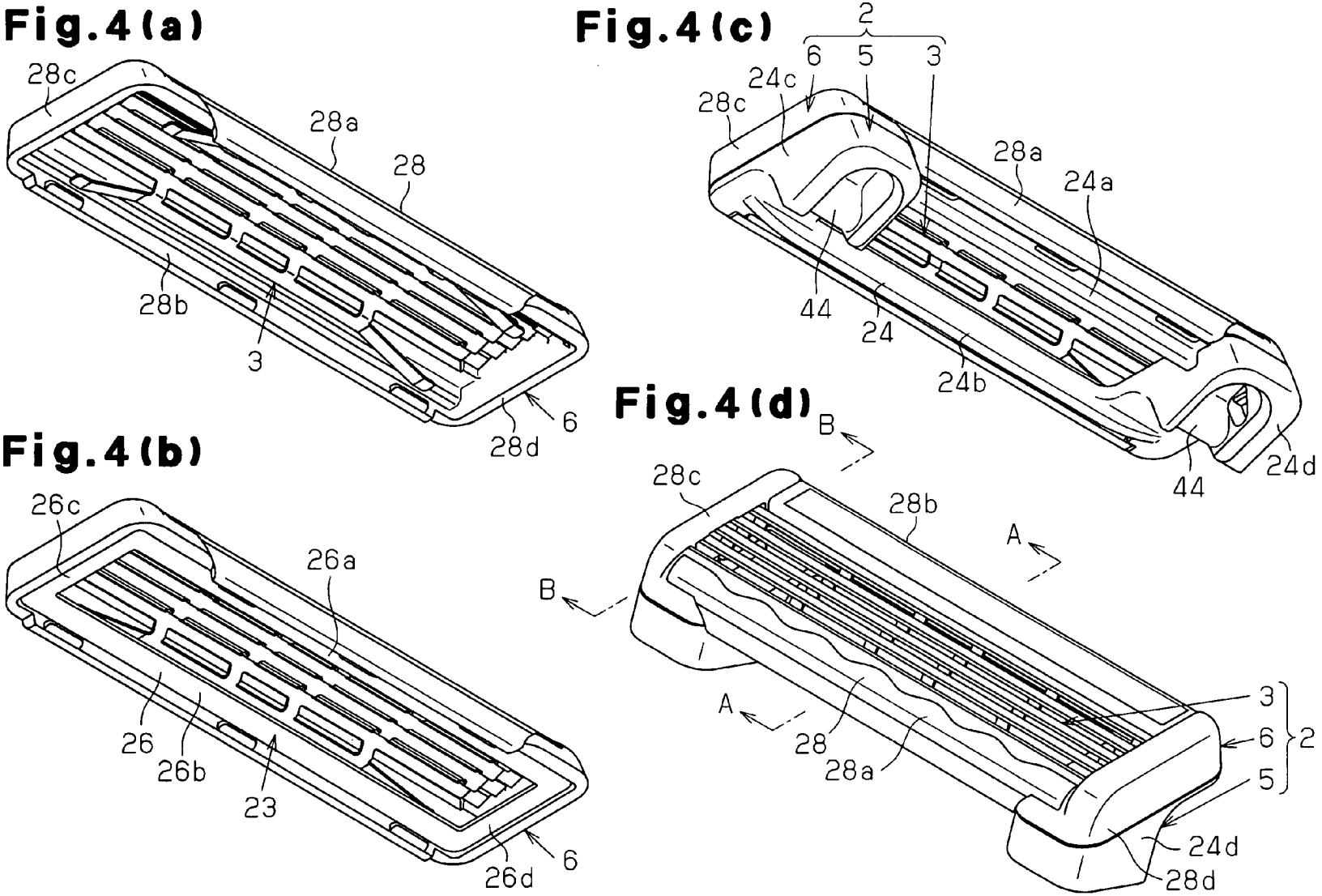
FIG. 4(*a*) is a perspective view showing a state in which the blade member is fitted into a top member.

As shown in FIGS. 4(*d*) and 5(*a*), the blade bodies 4 are arranged in a staircase pattern on the blade body attaching plate 14, and the cutting edge 4*a* of each blade body 4 is projected outward and forward from each step plate 16. Regarding any adjacent pair of blade bodies 4, the cutting edge 4*a* of the back blade body of the pair is closely spaced apart from a back edge portion 4*b* of the front blade body 4 of the pair. Also, for any adjacent pair of blade bodies, a clearance 21 facing each of the through holes 17 on the blade body attaching plate 14 is formed between the cutting edge 4*a* of the back blade body 4 of the pair and the back edge portion 4*b* of the front blade body 4 of the pair.

As shown in FIG. 2, the blade base member 5 is formed by a bottom base 22 made of plastic and a base plate 23 made of aluminum. In a case where the base 7, the blade bodies 4, and the base plate 23 are made of metal materials, it is preferable that the base plate 23 be made of a metal material higher in ionization tendency than that of the material forming the base 7 and that of the material forming the blade bodies 4. The thickness of the base plate 23 of the present embodiment is about 0.3 mm. The bottom base 22 is provided with a frame portion 24, and the frame portion 24 is provided with a front frame portion 24*a* located at the front, a back frame portion 24*b* at the back, a left frame portion 24*c* on the left, and a right frame portion 24*d* on the right as edge portions.

As shown in FIGS. 3(*b*) and 3(*c*), stoppers 24*e* on the left frame portion 24*c* and the right frame portion 24*d* are projected toward the blade body attaching plate 14 of the blade-body supporting portion 10. A debris discharge hole 25 is formed by a space enclosed by the frame portion 24. The base plate 23 is placed on the bottom base 22. Specifically, the frame portion 26 of the base plate 23 is superimposed on the frame portion 24 of the bottom base 22, and the through hole 27 of the base plate 23 communicates with the debris discharge hole 25 of the bottom base 22.

As shown in FIGS. 2 and 5(*a*), the top member 6 is made of plastic and provided with a frame portion 28. A blade body exposure hole 29 is formed by a space enclosed by the frame portion 28. The frame portion 28 is formed by a front frame portion 28*a*, a back frame portion 28*b*, a left frame portion 28*c*, and a right frame portion 28*d* as edge portions. A shaving aid is attached to the front frame portion 28*a* and the back frame portion 28*b*.

In a state where the blade member 3 is fitted between the blade base member 5 and the top member 6, the frame portion 24 of the blade base member 5 and the frame portion 28 of the top member 6 are superimposed on each other. Then, both front and back frame portions 24*a*, 24*b* of the blade base member 5 are mutually engaged with both front and back frame portions 28*a*, 28*b* of the top member 6 by each of locking recesses/projections (recesses 30*a* and projections 30*b*). Further, an instant adhesive agent is applied to the blade base member 5 and the top member 6 or applied between the blade base member 5 and the top member 6, by which the blade base member 5 and the top member 6 are bonded together.

As shown in FIGS. 3(*c*) and 5(*a*), in the blade member 3 located between the blade base member 5 and the top member 6, each leg plate 12 of each leaf spring 9 of the base 7 is placed on both front and back frame portions 26*a*, 26*b* on the base plate 23 of the blade base member 5. Each leaf spring 9 of the base 7 is inserted into a clearance 32 between both front and back frame portions 24*a*, 24*b* on the bottom base 22 of the blade base member 5 and both front and the back frame portions 28*a*, 28*b* on the top member 6, thus hidden from outside. As shown in FIGS. 4(*a*) to 4(*d*), 6(*a*), and 6(*b*), the blade bodies 4 are arranged in a staircase pattern along the X axis direction by the blade-body supporting portion 10, and both left and right end portions thereof are inserted between both left and right frame portions 24*c*, 24*d* on the bottom base 22 of the blade base member 5 and both left and right frame portions 28*c*, 28*d* on the top member 6. Each blade body 4 is pressed against both left and right frame portions 28*c*, 28*d* on the top member 6 by an elastic force of each leaf spring 9.

As shown in FIGS. 5(*a*) and 5(*b*), the cutting edge 4*a* of each blade body 4 is located in the vicinity of a shaving tangential plane 34 passing through a skin surface contact portion 33 formed on both front and back frame portion 28*a* and 28*b* of the top member 6. In each blade body 4, a straight line connecting the cutting edge 4*a* with the back edge portion 4*b* is inclined relative to the shaving tangential plane 34. Each blade body 4 moves integrally with the blade-body supporting portion 10 along the Z axis direction orthogonal to the shaving tangential plane 34 against the elastic force of each leaf spring 9.

In the blade member 3, the debris discharge hole 18 formed inside the placing base 8 of the base 7 communicates with the through hole 27 on the base plate 23 of the blade base member 5 and with the debris discharge hole 25 on the bottom base 22 through the opening 19, and also communicating with the blade body exposure hole 29 on the top member 6 through the opening 20.

When assembling the top member 6, the blade member 3, the bottom base 22, and the base plate 23 of the blade base member 5, first, as shown in FIG. 4(*a*), the blade member 3 is superimposed on the top member 6, thereafter, as shown in FIG. 4(*b*), the base plate 23 is superimposed on the blade member 3, and as shown in FIG. 4(*c*), the bottom base 22 is then superimposed on the base plate 23 and bonded to the top member 6. In this instance, each of the blade bodies 4 is welded to the blade-body supporting portion 10, and the blade member 3 is fitted between the blade base member 5 and the top member 6, thus simplifying the structure for supporting each of the blade bodies 4.

Figure 7A:
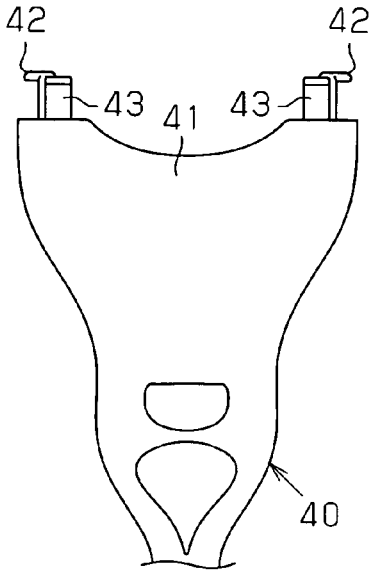
FIG. 7(*a*) is a plan view showing the head of a holder
Figure 7B:
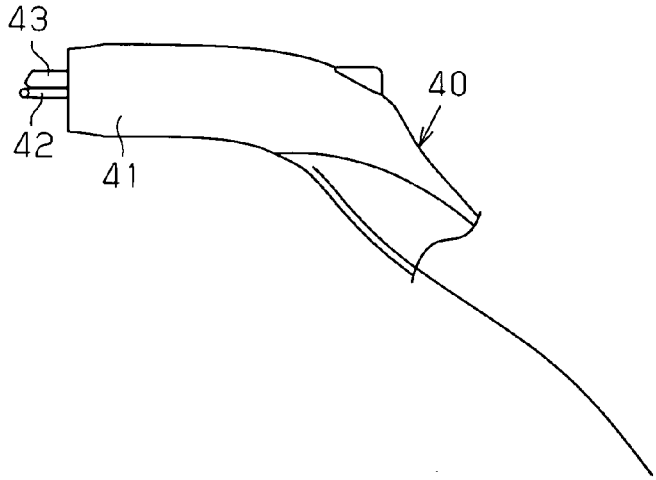
Figure 8A:
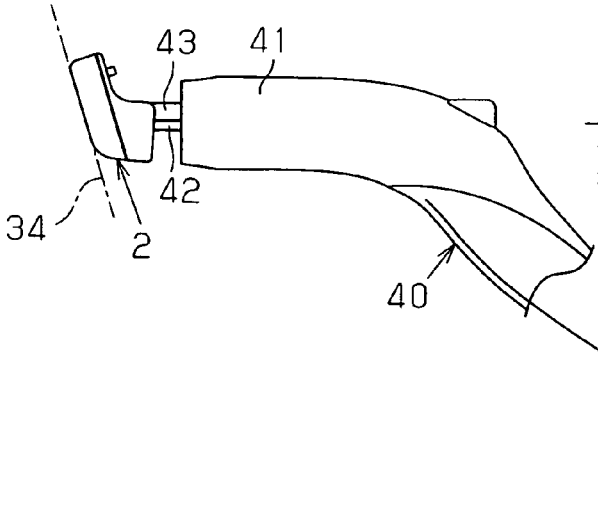
FIG. 8(*a*) is a side elevational view showing a state in which the razor head is supported on the head of the holder.
Figure 8B:
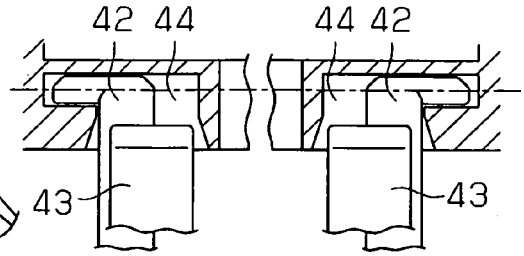

As shown in FIGS. 7(*a*) and 7(*b*), in the holder 40, supporting arms 42 and pushers 43 are projected forward from both left and right sides of the head portion 41 of the holder 40 in a state where they are arranged side by side. As shown in FIG. 2, recesses 44 are formed at the bottom of both left and right frame portions 24*c*, 24*d* on the bottom base 22 of the blade base member 5 of the razor head 2, and the debris discharge hole 25 is opened between the recesses 44. As shown in FIGS. 8(*a*) and 8(*b*), each supporting arm 42 is supported by each recess 44, and the razor head 2 is detachably supported to the head portion 41 of the holder 40 in a state where each recess 44 is pressed by each pusher 43. The razor head 2 is oscillatable vertically about each supporting arm 42 against an elastic force of each pusher 43.

When the oscillating razor 1 is used in a state where each of skin surface contact portions 33 of the top member 6 contacts the skin surface together with each blade body 4, each leaf spring 9 deflects against a pressing force given to each blade body 4, by which each blade body 4 is allowed to move elastically. As shown in FIGS. 5(*a*) and 5(*b*), an initial clearance G between the blade body attaching plate 14 and each stopper 24*e* is preferably in a range between 0.1 mm and 1.2 mm, and set to be 0.5 mm in the present embodiment. When the blade body attaching plate 14 is displaced only by this initial clearance G and contacts each of the stoppers 24*e*, each blade body 4 stops moving.

When a force is applied to the blade body attaching plate 14 along the Z axis direction orthogonal to the shaving tangential plane 34, the force is preferably from 0.784 to 1.372 N (80 to 140 gf) for about a 0.3 mm displacement of the blade body 4 and from 1.078 to 1.666 N (110 to 170 gf) for about a 0.5 mm displacement of the blade body 4. Debris generated at each blade body 4 are advanced from the opening 20 into the debris discharge hole 18 and discharged from the opening 19 into the debris discharge hole 25 of the blade base member 5 in the blade member 3.

The above embodiment may be modified as follows.

The holder 40 may be disposed integrally with the razor head 2. In this instance, for example, the holder 40 is formed integrally with the bottom base 22.

The skin surface contact portions 33 may be disposed on the blade base member 5, instead of on the top member 6. Of these skin surface contact portions 33 of the top member 6, the skin surface contact portion 33 located at the front of the top member 6 may be omitted and another skin surface contact portion 33 may be disposed on the blade base member 5. Of these skin surface contact portions 33 of the top member 6, the skin surface contact portion 33 located at the back of the top member 6 may be omitted, and another skin surface contact portion 33 may be disposed on the blade base member 5.

The leaf springs 9 may be disposed not only at the front and back of the placing base 8 but also on the left and right thereof. The leaf springs 9 at the front and back of the placing base 8 may be omitted, and another set of leaf springs 9 may be disposed on the left and right. Further, each leaf spring 9 as a placing body may be omitted and the placing body may be formed by using an elasticity-free member.

A plurality of rods, for example, square rods, round rods and other shapes of rods may be arrayed in a lattice form and bent to form the base 7.

In addition to the laser welding, for example, resistance welding, ultrasonic welding, electron beam welding, and plasma welding may be used. In the laser welding, a laser is only radiated from the side corresponding to the blade-body supporting portion 10. Thus, the laser welding is simpler in preparing welding equipment than such welding that is performed with the blade-body supporting portion 10 and the blade body 4 held between other members.

Each leg plate 12 of each leaf spring 9 may be changed in spring constant by changing the width in the front-back direction or thickness. The leg plates 12 may have different spring constants, so that elastic displacement varies among the blade bodies 4.

A cutting edge may be provided at the back edge portion 4*b*, in addition to the cutting edge 4*a* located at the front edge portion of each blade body 4, and a cutting edge located at the back edge portion 4*b* may be exposed outward.

At the blade-body supporting portion 10 of the base 7, a pair of blade body attaching plates 14 formed in a staircase pattern may be arranged parallel along the X axis direction. In this instance, the cutting edge 4*a* of each blade body 4 located at the front is exposed at a blade body exposure hole 29 on the top member 6 due to the blade body attaching plate 14 located at the front. The cutting edge 4*a* of each blade body 4 located at the back is exposed at the blade body exposure hole 29 of the top member 6 due to the blade body attaching plate 14 located at the back.

The number of the blade bodies 4 may be changed to five, six or eight, for example, other than four blade bodies at the blade-body supporting portion 10 of the base 7. In this instance, a blade body attaching plate 14 formed in a staircase pattern is divided into two pieces in the front-back direction. An appropriate number of the blade bodies 4 are arranged on the blade body attaching plate 14 located at the front. The remaining number of the blade bodies 4 are arranged on the blade body attaching plate 14 located at the back. Further, the blade body attaching plate 14 may be divided into two pieces to attach the blade body attaching plate 14 located at the front to the blade body attaching plate 14 located at the back.

The invention claimed is:

1. A razor comprising a razor head, wherein the razor head includes:

a blade member that includes a blade body and a base, wherein the base includes a blade-body supporting portion and a placing base attached to the blade-body supporting portion, the placing base includes a pair of leaf springs, and the blade-body supporting portion is formed between the leaf springs, a blade base member located on a bottom side of the razor head; and a top member located on a top side of the razor head, wherein the blade member is fitted between the blade base member and the top member, the base of the blade member is supported on the blade base member by the leaf springs, a cutting edge of the blade body is exposed outward at the top member, the blade body is placed on the blade-body supporting portion of the base and attached to the blade-body supporting portion by welding.

2. The razor according to claim 1, wherein the welding is laser welding.

3. The razor according to claim 1, wherein the blade body is one of a plurality of blade bodies, the blade member includes the plurality of blade bodies, the blade-body supporting portion of the base is provided with a plurality of parallel blade body attaching portions arranged in a staircase pattern along a direction orthogonal to a direction in which the cutting edge of the blade body extends, and the blade bodies are placed on the blade body attaching portions and attached to the blade body attaching portions, respectively, by the welding.

4. The razor according to claim 1, wherein the blade base member is further provided with a base plate, the base of the blade member is supported on the base plate, and the base, the blade body and the base plate are made of metal materials, and the metal material of the base plate has an ionization tendency higher than the metal material of the base and the metal material of the blade body.

5. The razor according to claim 1, wherein the leaf springs extend generally in a longitudinal direction of the blade body, mid-sections of the leaf springs are attached to the blade-body supporting portion, and each of the leaf springs has a pair of end portions that rest on the blade base member, and the end portions are located at opposite longitudinal ends of the respective leaf springs.

6. The razor according to claim 1, wherein the placing base and the blade-body supporting portion comprise an integral press-worked metal placement base and blade-body supporting portion.

7. A razor comprising a razor head, wherein the razor head includes:

a blade base member located on a bottom side of the razor head;

a blade member supported on the blade base member, the blade member including a base that includes a blade-body supporting portion and a placing base attached to the blade body supporting portion, and the placing base includes a pair of leaf springs; and a blade body exposed outward on a top side of the razor head; and a skin surface contact portion, which contacts a skin surface together with a cutting edge of the blade body, wherein the blade body is placed on the blade-body supporting portion of the base, welded portions fixed to each other by welding from a side corresponding to the blade-body supporting portion are disposed in the blade body and the blade-body supporting portion, the base is supported on the blade base member by the leaf springs, and the blade-body supporting portion is formed between the leaf springs.

8. The razor according to claim 7, wherein, at the welded portions, the thickness of the blade-body supporting portion is set to be greater than the thickness of the blade body.

9. The razor according to claim 7, wherein the leaf springs extend generally in a longitudinal direction of the blade body, mid-sections of the leaf springs are attached to the blade-body supporting portion, and each of the leaf springs has a pair of end portions that rest on the blade base member, and the end portions are located at opposite longitudinal ends of the respective leaf springs.

10. The razor according to claim 7, wherein the placing base and the blade-body supporting portion comprise an integral press-worked metal placement base and blade-body supporting portion.

11. A razor comprising a razor head, wherein the razor head includes:

a blade base member located on a bottom side of the razor head;

a blade member supported on the blade base member, wherein the blade member comprises a base, which includes a blade-body supporting portion and a placing base attached to the blade body supporting portion, and a plurality of blade bodies, cutting edges of which are exposed outward on a top side of the razor head, the placing base of the base is provided with a pair of leaf springs supported on the blade base member; and a skin surface contact portion, which contacts a skin surface together with the cutting edges of the blade bodies, wherein the blade body supporting portion is formed between the pair of leaf springs, the blade bodies are placed on the blade-body supporting portion, and the blade bodies are attached to the blade-body supporting portion by welding.

12. The razor according to claim 11, wherein the welding is laser welding.

13. The razor according to claim 11, wherein the blade-body supporting portion of the base is provided with a plurality of parallel blade body attaching portions arranged in a staircase pattern along a direction orthogonal to a direction in which the cutting edge of the blade body extends, and the blade bodies are placed on the blade body attaching portions and attached to the blade body attaching portions, respectively, the welding.

14. The razor according to claim 11, wherein the leaf springs extend generally in a longitudinal direction of the blade bodies, mid-sections of the leaf springs are attached to the blade-body supporting portion, and each of the leaf springs has a pair of end portions that rest on the blade base member, and the end portions are located at opposite longitudinal ends of the respective leaf springs.

15. The razor according to claim 11, wherein the placing base and the blade-body supporting portion comprise an integral press-worked metal placement base and blade-body supporting portion.

16. The razor according to claim 11, wherein the pair of leaf springs comprise a pair of mutually facing leaf springs supported on the blade base member, and the placing base is supported on the blade base member.

* * * * *